US005209000A

United States Patent [19]

Rowland et al.

[11] Patent Number: 5,209,000

[45] Date of Patent: May 11, 1993

[54] DISPLAY FOR FOOTWEAR

[76] Inventors: Edward P. Rowland, 660 Arlington Dr., Seaford, N.Y. 11783; George Spector, 233 Broadway Rm. 3815, New York, N.Y. 10007

[21] Appl. No.: 658,230

[22] Filed: Feb. 20, 1991

[51] Int. Cl.[5] ..... A43B 5/00; A43B 23/24

[52] U.S. Cl. ..... 36/136; 36/132; 2/245; 24/712.3

[58] Field of Search ..... 36/136, 132; 2/245; D2/265, 305; 24/712.3, 713.3, 713.4, 115 H

[56] References Cited

U.S. PATENT DOCUMENTS

| | | | |
|---|---|---|---|
| D. 103,602 | 3/1937 | Spalsbury | D2/265 |
| 837,870 | 12/1906 | Myers | 2/245 X |
| 1,344,998 | 6/1920 | Fay | 2/245 |
| 1,460,743 | 7/1923 | Binns et al. | 2/245 X |
| 1,718,440 | 6/1929 | Smith | 24/713.4 |
| 2,069,964 | 2/1937 | Miller | 2/245 X |
| 2,636,237 | 4/1953 | Price | 24/712.3 |
| 2,871,537 | 2/1959 | Hickerson | 36/136 X |
| 3,122,805 | 3/1964 | Hakim | 2/245 |
| 3,473,198 | 10/1969 | Meier | 24/712.3 |
| 4,507,882 | 4/1985 | Harrell | 36/136 |
| 4,536,975 | 8/1985 | Harrell | 36/136 |
| 4,597,198 | 7/1986 | Schweitzer | 36/136 X |
| 4,766,682 | 8/1988 | Malloy, III | 36/136 X |
| 4,852,276 | 8/1989 | Savoca et al. | 36/136 |
| 4,916,833 | 4/1990 | Nwoko | 36/50 |

FOREIGN PATENT DOCUMENTS

| | | | |
|---|---|---|---|
| 1347424 | 5/1972 | United Kingdom | 36/136 |
| 8001750 | 9/1980 | World Int. Prop. O. | 36/132 |

*Primary Examiner*—Jimmy G. Foster
*Assistant Examiner*—Ted Kavanaugh

[57] ABSTRACT

A display attachment is provided for a shoe of the type having a lace, an instep, a pair of flaps and a tongue. The attachment consists of a flexible plate having a curved to edge, a fringed bottom edge, a pair of tapering side edges and a pair of spaced apart apertures formed within the plate proximate the curved top edge so that the ends of the lace can be inserted through said apertures and tied together with the plate covering the instep, flaps and tongue of the shoe. Indicia is placed upon the front face of the plate for decorative appearance thereof.

2 Claims, 1 Drawing Sheet

DISPLAY FOR FOOTWEAR

BACKGROUND OF THE INVENTION

The instant invention relates generally to footwear accessories and more specifically it relates to a display attachment for a shoe which provides a detachable ornamental plate that is in engagement with the lace of the shoe.

There are available various conventional footwear accessories which do not provide the novel improvements of the invention herein disclosed.

SUMMARY OF THE INVENTION

A primary object of the present invention is to provide a display attachment for a shoe that will overcome the shortcomings of the prior art devices.

Another object is to provide a display attachment for a shoe that is a detachable ornamental plate in engagement with the lace of the shoe so that the plate can cover the instep, flaps and tongue of the shoe.

An additional object is to provide a display attachment for a shoe in which indicia can be placed upon the face of the plate for a decorative appearance thereof.

A further object is to provide a display attachment for a shoe that is simple and easy to use.

A still further object is to provide a display attachment for a shoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
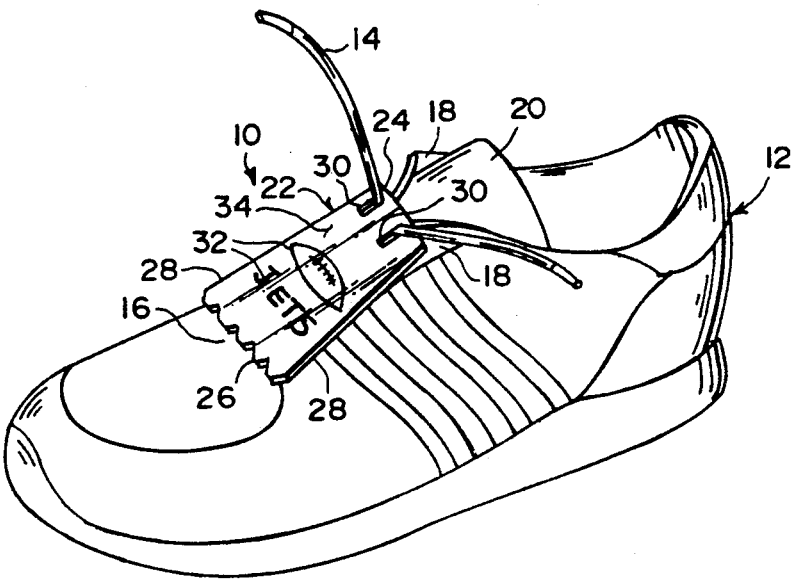
FIG. 1 is a perspective view of a shoe with the instant invention installed thereon.
Figure 2:
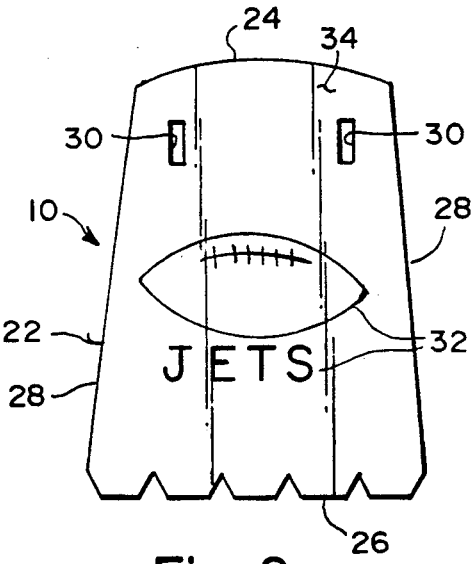
FIG. 2 is a top view of the instant invention per se.
Figure 3:
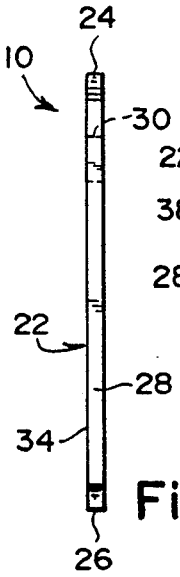
FIG. 3 is a side view thereof.

Turning now descriptively to the drawings, in which similar reference characters denote similar elements throughout the several views, the Figures illustrate a display attachment 10 for a shoe 12 of the type having a lace 14, and instep 16, a pair of flaps 18 and a tongue 20. The attachment 10 consists of a flexible plate 22 having a curved top edge 24, a fringed bottom edge 26, a pair of tapering side edges 28 and a pair of spaced apart apertures 30 formed within the plate 22 proximate the curved top edge 24. The ends of the lace 14 can be inserted through the apertures 30 and tied together with the plate 22 covering the instep 16, flaps 18 and tongue 20 of the shoe 12. Indicia 32 is placed upon the front face 34 of the plate 22 for a decorative appearance thereof.

Figure 4:
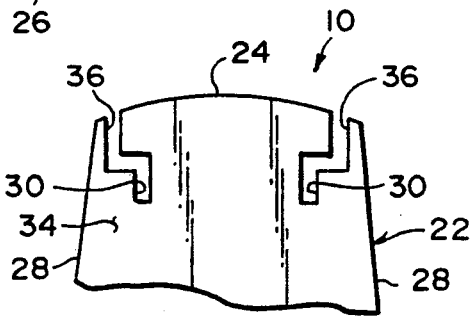
FIG. 4 is a top view of a portion of a modification showing L-shaped slots extending upwardly from the apertures for easy assembly and disassembly of the lace.

The plate 22, as shown in FIG. 4, can have a pair of L-shaped slots 36 with each extending from one of the apertures 30 to the curved top edge 24 for easy assembly and disassembly of the lace 14.

Figure 5:
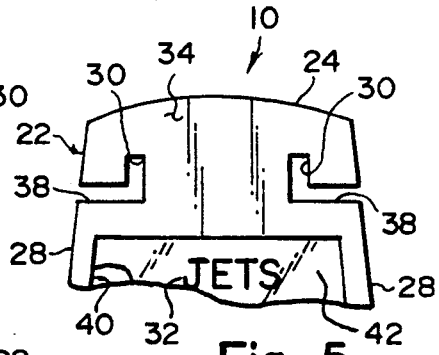
FIG. 5 is a top view of a portion of another modification showing slots extending outwardly from the apertures for easy assembly and disassembly of the lace and a window for the indicia to be inserted therein.

The plate 22, as shown in FIG. 5, can have a pair of slots 38, with each extending from one of the apertures 30 to one of the tapering side edges 28 for easy assembly and disassembly of the lace 14. The plate 22 can also have a recessed window 40 in the front face 34 thereof so that the indicia 32 can be placed within the recessed window 40. A transparent cover 42 is placed over the indicia 32 in the recessed window 40 to protect the indicia 32 therein.

The plate 22 can be fabricated out of plastic, leather, cloth or any other flexible materials. The indicia 32 can be athletic symbols, team names, horoscope symbols, first names, school names, logos, and other types of sayings.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A display attachment for a shoe of the type having a lace, an instep, a pair of flaps and a tongue, said attachment comprising:

a) a flexible plate having a curved top edge, a fringed bottom edge, a pair of tapering side edges and a pair of spaced apart apertures formed within said plate proximate the curved top edge so that the ends of the lace can be inserted through said apertures and tied together with said plate covering the instep, flaps and tongue of the shoe; and b) indicia placed upon the front face of said plate for a decorative appearance thereof; and c) a recessed window with a transparent cover for placement of indicia therein; further including said plate having a pair of L-shaped slots, each extending from one of the apertures to the curved top edge for easy assembly and disassembly of the lace.

2. A display attachment for a shoe of the type having a lace, an instep, a pair of flaps and a tongue, said attachment comprising:

a) a flexible plate having a curved top edge, a fringed bottom edge, a pair of tapering side edges and a pair of spaced apart apertures formed within said plate proximate the curved top edge so that the ends of the lace can be inserted through said apertures and tied together with said plate covering the instep, flaps and tongue of the shoe; and b) indicia placed upon the front face of said plate for a decorative appearance thereof; and c) a recessed window with a transparent cover for placement of indicia therein, further including said plate having a pair of slots, each extending from one of the apertures to one of the tapering side edges for easy assembly and disassembly of the lace.

* * * * *